United States Patent [19]

Asher et al.

[11] 4,349,181

[45] Sep. 14, 1982

[54] END OR CORNER FENCE POST CONSTRUCTION

[76] Inventors: Lynn E. Asher, 121 Winona St.; Antony J. Conway, R.R. 1, both of Chatfield, Minn. 55923

[21] Appl. No.: 50,498

[22] Filed: Jun. 20, 1979

[51] Int. Cl.[3] ..... E04H 17/02

[52] U.S. Cl. ..... 256/35; 256/22; 52/152

[58] Field of Search ..... 256/35, 36, DIG. 5, 256/22, 34; 52/152

[56] References Cited

U.S. PATENT DOCUMENTS

| | | | |
|---|---|---|---|
| 387,413 | 8/1888 | Griffin et al. | 256/35 |
| 394,773 | 12/1888 | Jones | 52/152 |
| 519,743 | 5/1894 | Talbert | 256/35 X |
| 528,109 | 10/1894 | Pratt | 52/152 |
| 562,328 | 6/1896 | Wolcott et al. | 256/35 |
| 584,175 | 6/1897 | Haley | 252/35 |
| 625,278 | 5/1899 | Spoore | 256/35 |
| 696,520 | 4/1902 | Van Valkenburg | 256/35 |
| 781,537 | 1/1905 | Lower | 256/35 |
| 891,246 | 6/1908 | Grissom | 256/35 |
| 999,786 | 8/1911 | Heyerly | 256/35 |
| 1,017,833 | 2/1912 | White | 256/35 |
| 1,408,132 | 2/1922 | Norton | 256/35 |
| 1,504,494 | 8/1924 | Parsons | 256/35 |
| 1,911,483 | 5/1933 | Thompson | 52/152 |
| 1,981,447 | 11/1934 | Clark | 256/35 |
| 2,199,518 | 5/1940 | Coleman | 256/35 |
| 3,334,867 | 8/1967 | Wenaas | 256/35 |

*Primary Examiner*—Andrew V. Kundrat

*Attorney, Agent, or Firm*—Kinney, Lange, Braddock, Westman & Faibairn

[57] ABSTRACT

An end or corner fence post construction having a main upright post supported by a main brace, the main post having a deadman plate attached near its lower end below ground level and the main brace having a bearing plate rigidly and perpendicularly attached below ground level. A cross brace having its lower end fixedly attached to the main post and its upper end fixedly attached to the main brace.

10 Claims, 5 Drawing Figures

END OR CORNER FENCE POST CONSTRUCTION

BACKGROUND OF THE INVENTION

1. Field of the Invention

The present invention relates to fence post construction and in particular to braced fence posts anchored below ground level.

2. Description of the Prior Art

Barbed and woven wire fences are relied upon heavily for partitioning livestock on a typical farm. The end units and corners of these fences bear the entire load of the stretched wire ranging from 3,000 lbs. to 5,000 lbs. Fence failure is almost always due to the failure of the end and corner posts.

Typically, the failure is caused by improper construction or inherent design weaknesses. Frost upheaval forces and pushing livestock work on these weaknesses, causing a decrease in wire tension and ultimate fence failure.

The Haley U.S. Pat. No. 584,175 shows a main post with a deadman below ground level, a main brace with its upper end attached to the upper end of the main post and the lower end attached to a cross brace that is adjacent to the ground level and attached to the main post at ground level. This type of construction will not withstand the high tension forces of a barbed wire fence. The point where the cross brace and main brace are joined has no support, other than the ground itself, to counter the tension forces of the wire near the top of the fence.

In the Wenaas U.S. Pat. No. 3,334,867 the tension problems of the Haley patent are solved but by the use of three posts which are connected by a plurality of braces. This type of construction is both time consuming and costly. Further, frost upheaval will eventually deteriorate even this system since there are no below ground anchoring devices.

SUMMARY OF THE INVENTION

The present invention includes a main post anchored beneath the ground by a rigidly attached deadman. A main brace is attached near the upper end of the main post and engages the ground at the other end. A bearing plate below ground level is rigidly attached to the ground engaging end of the main brace at about a 90° angle. The bearing plate has a lower pointed end to facilitate its entry into the ground. A cross brace is attached to the main post near ground level and to the main brace at a higher point, providing rigidity to the overall construction, thereby statically combining the features of the deadman and the bearing plate into the unit.

The present invention requires only one post hole to dig and provides resistance to both vertical forces such as frost upheaval forces and lateral tension forces such as forces transmitted through barbed wire by pushing cattle. The deadman protects the main post from frost upheaval forces by its horizontal position below ground level which provides resistance to vertical forces. The bearing plate provides resistance to lateral tension forces by being rigidly attached to the main brace at about a 90° angle. The lateral tension forces will force the bearing plate deeper into the ground instead of merely pulling it horizontally since the bearing plate is at an incline with respect to the ground level and the main brace is rigidly connected to the main post by the cross brace. In this manner, the present invention provides a solution by combining a minimal number of elements to counteract the forces that most frequently are the cause of fence failures.

DETAILED DESCRIPTION OF THE PREFERRED EMBODIMENTS

Figure 1:
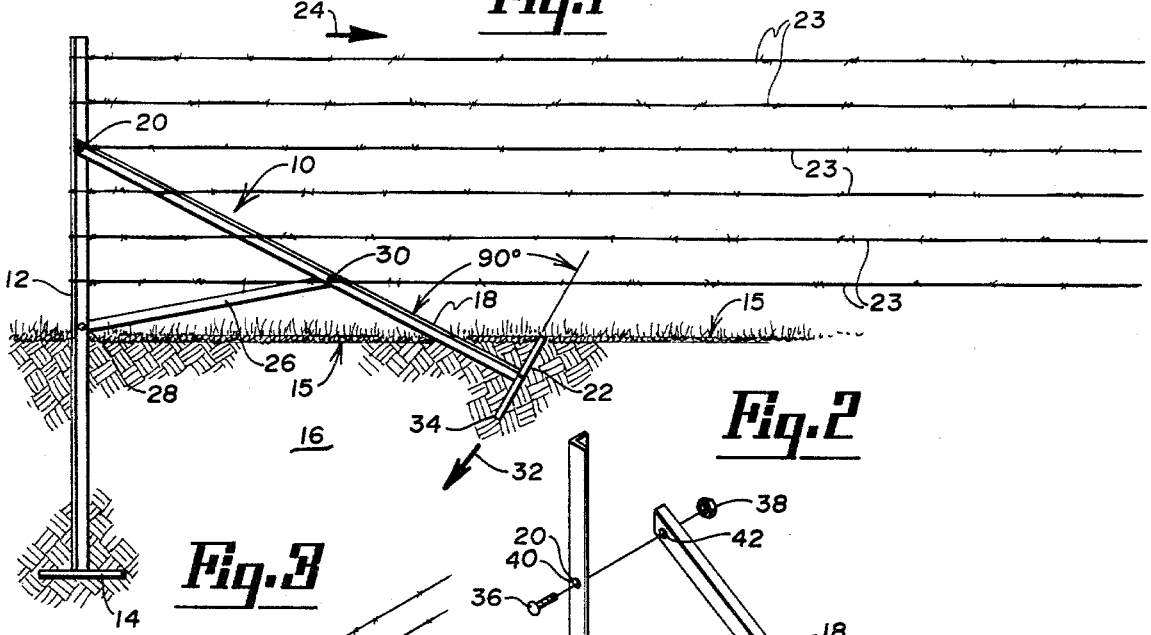
FIG. 1 is an elevational view of an end post construction of the present invention.
Figure 5:
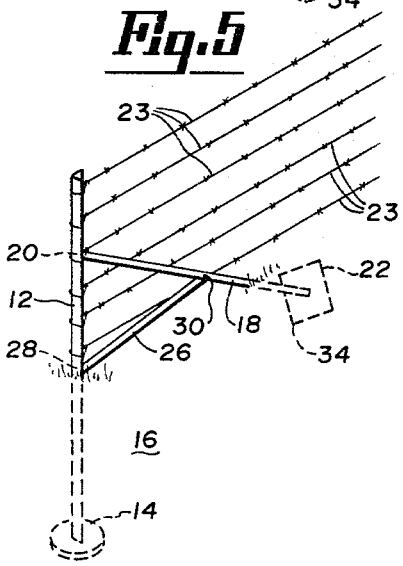
FIG. 5 is a perspective view of a fence end post construction.

Referring to FIG. 1, an end unit construction of the present invention is generally shown at 10. The main post 12 is rigidly attached to a deadman 14 below ground level 15. The deadman 14 is preferably a circular flat plate though it can be of any configuration. Since most post holes are dug cylindrically, the circular configuration of the deadman 14, while conforming to the shape of the post hole, also provides the maximum amount of area to resist vertical upheaval forces when the hole is filled. The deadman plate 14 is secured to the post 12 perpendicularly thereto so that when the post is installed, the deadman plate is disposed horizontally. As can be seen in FIGS. 1 and 5, the deadman 14 will work against vertical forces because of its horizontal position beneath the ground 16 and the soil above. Fence wires 23 are secured to post 12 at spaced intervals to form a fence.

A main brace 18 is fixedly attached to an upper portion of the main post 12 at point 20 and is rigidly attached to bearing plate 22 below ground level 15 at about a 90° angle. The bearing plate 22 counters the lateral forces 24 transmitted by the wires 23 by digging deeper into the ground as a result of its inclined position.

A cross brace 26 is fixedly attached near ground level at point 28 to the main post 12 and is fixedly attached at a higher point indicated by 30 to the main brace 18. The cross brace 26 completes a rigid structure with the main post 12 and the main brace 18. This rigid structure statically combines the features of the deadman 14 and the bearing plate 22 into the unit.

Without the cross brace, lateral forces as indicated by arrow 24 in FIG. 1 and wet soil may combine to effect a horizontal "bulldozing" of the bearing plate 22. The bearing plate will move horizontally or bulldoze" in the direction of the lateral forces when the ground is wet without a cross brace 26 in the construction. With the cross brace 26 the deadman 14 provides an anchoring point and the bearing plate 22 at an incline and acting in combination with the deadman 14 will move deeper into the ground as indicated by arrow 32 in counteracting any lateral forces 24.

The bearing plate, as shown in FIG. 5, preferably has a parallelogram configuration with one point 34 of the parallelogram pointed in a downward direction. This facilitates the insertion of the bearing plate 22 into the ground 16.

Figure 2:
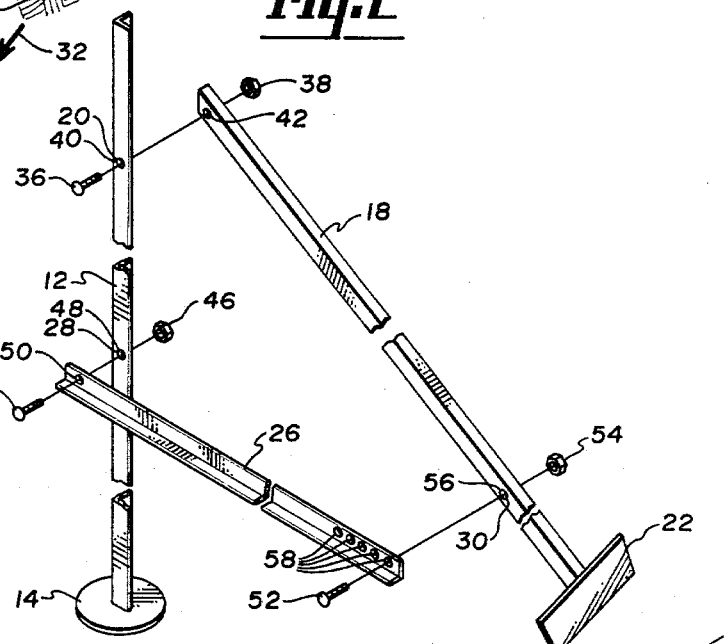
FIG. 2 is an exploded view of an end post construction of the present invention.

FIG. 2 shows the end post construction of the present invention in its pre-assembled state. The main post 12 rigidly attached to the deadman 14 and the main brace 18 rigidly attached to the bearing plate 22 and the cross brace can be shipped unassembled as a compact unit. Further, a farmer can store such end posts unassembled conveniently along with his regular fence posts ready for use when needed.

In assembly, the main post 12 with the deadman 14 is placed in a post hole. The main brace 18 is then bolted with bolt 36 and nut 38 to the main post 12 at point 20 by aligning apertures 40 and 42. The bearing plate 22 at point 34 is forced into the ground with the main brace 18 pivoting at point 20 eliminating the need to dig a hole for the bearing plate. After the bearing plate 22 is inserted into the ground 16, the cross brace 26 is bolted to the main post 12 at point 28 with bolt 44 and nut 46 by aligning apertures 48 and 50. Lastly, the cross brace is bolted to the main brace 18 with bolt 52 and nut 54 by aligning aperture 56 with one aperture of a plurality of apertures indicated by 58 on the cross brace. It should be understood that other fasteners may be used in place of the bolts and nuts without departing from the scope of the invention.

Figure 3:
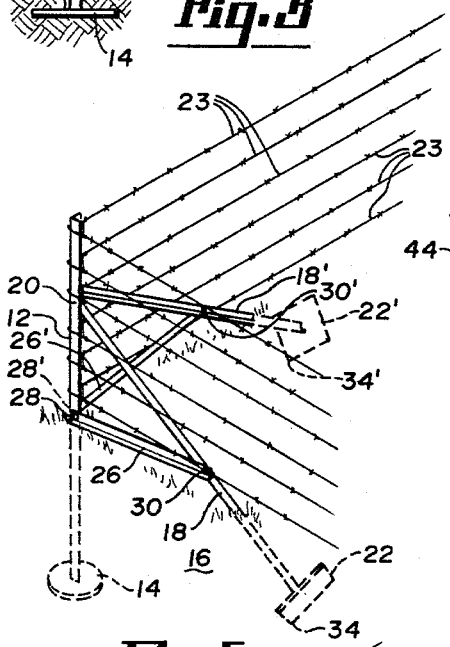
FIG. 3 is a perspective side view of a fence corner construction.
Figure 4:
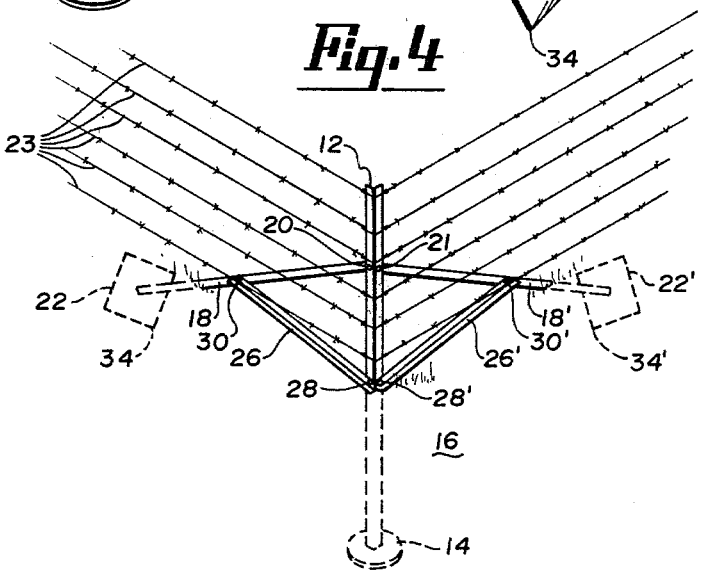
FIG. 4 is a perspective front view of a fence corner construction.

The corner post construction of the present invention is shown in FIGS. 3 and 4. Briefly, referring to FIG. 4, the corner fence post construction includes a main post 12 rigidly attached to a deadman 14 below ground level. A first main brace 18 is fixedly attached to the main post at point 20 and is rigidly attached to a first bearing plate 22 at about a 90° angle below ground level. The second main brace 18' is fixedly attached to the main post 12 at point 20' and is rigidly attached to a second bearing plate 22' at about a 90° angle below ground level. The second main brace 18' is in a vertical plane perpendicular to the vertical plane of first main brace 18.

A first cross brace 26 is attached near ground level to the main post 12 at point 28 and is attached at a higher point 30 to the first main brace 18. A second cross brace 26' is attached near ground level at point 28' to the main post 12 and is attached at a higher point 30' to the second main brace 18'.

As can be seen from FIGS. 3 and 4, the corner post construction of the present invention is an extension of the end post construction shown in FIGS. 1, 2 and 5. The corner post construction is assembled in a similar manner as described previously. First, the main post 12 with the deadman 14 is inserted into the ground 16. A first main brace 18 is bolted to the main post at point 20 and the bearing plate 22 is forced into the ground 16 while the first main brace 18 pivots at point 20. Similarly, the second main brace 18' is bolted to the main post 12 at point 21 and the bearing plate 22' is forced into the ground 16 while the second main brace 18' pivots at point 21. The cross braces 26 and 26' are then bolted near ground level to the main post 12 at points 28 and 28' and at a higher point to main braces 18 and 18' at points 30 and 30', respectively.

The main post 12, the main brace 18 and the cross brace 26 can be made of any suitably rigid material such as angle iron, tubular steel or fiberglass. The bearing plate 22 and deadman 14 are preferably welded to main brace 18 and main post 12, respectively.

Although the present invention has been described with reference to preferred embodiments, persons skilled in the art will recognize that changes shall be made in form and detail without departing in spirit and scope of the invention.

What is claimed is:

1. An end fence post construction comprising:

main upright post means with an upper and a lower end;

inclined main brace means with an upper and a lower end, said upper end of the main brace means being fixedly attached to the upper end of the main post means;

bearing plate means rigidly attached to the lower end of said main brace means and extending laterally beyond said brace means in all directions, said bearing plate means having a plate means area measured perpendicular to the main brace means substantially greater than the cross sectional area of the main brace means and having a lower narrow edge facing downwardly and lying along a plane generally perpendicular to the main brace means, said edge including a downwardly facing lower portion and widening substantially continuously upwardly from the lower portion to a region of maximum width of the bearing plate means to facilitate penetration of the bearing plate means into the ground and to resist movement of the main brace means in a direction parallel to the main brace means;

rigid cross brace means with first and second ends, said first end of the cross brace means being fixedly attached to the main post means adjacent the ground and the second end of the cross brace means extending upwardly and being fixedly attached to the main brace means; and deadman means rigidly attached adjacent to the lower end of said post means and positioned below ground when the post means is installed.

2. An end fence post construction as described in claim 1 wherein said bearing plate means is a flat plate having a parallelogram configuration with four corners and in which one of said corners extends below the other three corners so as to constitute the downwardly facing portion.

3. An end fence post construction as described in claim 1 wherein said deadman means is a circular plate.

4. An end fence post construction as described in claim 1 wherein the main upright post means, inclined main brace means and cross brace means are fixedly attached to each other with conventional nuts and bolts.

5. A corner fence post construction comprising:

main upright post means with an upper and a lower end;

a first main brace means with an upper and a lower end, said upper end of said first main brace means being fixedly attached to the upper end of the main post means;

a second main brace means with an upper and a lower end, said upper end of said second main brace means being fixedly attached to the upper end of the main post means and perpendicular to the first main brace means;

a first bearing plate means comprising a flat parallelogram plate having four corners and being below ground level and perpendicularly and rigidly attached to the lower end of said first main brace means with one corner below the other three corners and pointing downward;

a second bearing plate means comprising a flat parallelogram plate having four corners and being below ground level and perpendicularly and rigidly attached to the lower end of said second main brace means with one corner below the other three corners and pointing downward;

a first cross brace means with an upper and a lower end, said lower end being fixedly attached to the main post means and the upper end being fixedly attached to the first main brace means;

a second cross brace means with an upper and a lower end, said lower end being fixedly attached to the main post means and the upper end being fixedly attached to the second main brace means; and deadman means below ground level rigidly attached to said main post means and adjacent to the lower end thereof.

6. A corner fence post as described in claim 5 wherein said deadman means is a circular plate.

7. A corner fence post construction as described in claim 5 wherein the main upright post means, the first main brace means and the first cross brace means are fixedly attached to each other with conventional nuts and bolts and the main upright post means, the second main brace means and second cross brace means are fixedly attached to each other with conventional nuts and bolts.

8. An end fence post construction comprising:

main upright post means with an upper and a lower end;

inclined main brace means with an upper and a lower end, said upper end of the main brace means being fixedly attached to the upper end of the main post means;

bearing plate means comprising a generally flat plate rigidly attached substantially perpendicular to the lower end of the main brace means, said flat plate having a parallelogram configuration with four corners, said plate being attached to the main brace means at such a position the one corner is pointed downwardly below the other three corners to facilitate insertion of the bearing plate means into the ground with at least the major portion of the plate below ground level;

rigid cross brace means with upper and lower ends, said lower end of the cross brace means being fixedly attached to the main post means and the upper end of the cross brace means being fixedly attached to the main brace means; and deadman means rigidly attached adjacent to the lower end of said post means and positioned below ground when the post means is installed.

9. A method of constructing an end fence post comprising:

inserting into a post hole a main upright post means having an upper and a lower end, said lower end being rigidly attached to a deadman means and perpendicular thereto;

fixedly and detachably attaching an inclined main brace means having an upper and a lower end to the upper end of said main post means, said main brace means being rigidly and perpendicularly attached to a bearing plate means at the lower end;

pivoting said main brace means about a point of attachment to the main post means in a downward direction while inserting said bearing plate means below ground level; and fixedly and detachably attaching a rigid cross brace means having an upper and a lower end to the main post means and the main brace means with the lower end of said cross brace means being secured to said main post means and the upper end of said cross brace means being secured to the main brace means, thereby completing a rigid structure.

10. A method of constructing a corner fence post comprising:

inserting into a post hole a main upright post means having an upper and a lower end, said lower end being rigidly attached to a deadman means;

fixedly and detachably attaching a first main brace means having an upper and a lower end to the upper end of said main post means, said first main brace means being rigidly and perpendicularly attached to a first bearing plate means at the lower end;

pivoting said first main brace means about a point of attachment to the main post means in a downward direction while inserting said first bearing plate means below ground level;

fixedly and detachably attaching a second main brace means having an upper and a lower end to the upper end of said main post means and perpendicular to the first main brace means; said second main brace means being rigidly and perpendicularly attached to a second bearing plate means at the lower end;

pivoting said second main brace about a point of attachment to the main post means in a downward direction while inserting said second bearing plate means below ground level;

fixedly and detachably attaching a first cross brace means having an upper and lower end to the main post means and said main brace means being secured to said main post means and the upper end of said cross brace means being secured to the first main brace means; and fixedly and detachably attaching a second cross brace means having an upper and lower end to the main post means and the second main brace means with the lower end of said cross brace means being secured to said main post means and the upper end of said cross brace means being secured to the second main brace means thereby completing a rigid structure.

* * * * *